United States Patent [19]

Matsumoto et al.

[11] 4,144,070

[45] Mar. 13, 1979

[54] LIGHT-SENSITIVE SILVER HALIDE PHOTOGRAPHIC MATERIALS

[75] Inventors: Masayuki Matsumoto; Toshio Nagatani; Noboru Fujimori, all of Hino, Japan

[73] Assignee: Konishiroku Photo Industry Co., Ltd., Nihonbashi-Muro, Japan

[21] Appl. No.: 853,520

[22] Filed: Nov. 21, 1977

[30] Foreign Application Priority Data

Nov. 22, 1976 [JP] Japan ..... 51-140475

[51] Int. Cl.[2] ..... G03C 5/30; G03C 1/08

[52] U.S. Cl. ..... 96/66 R; 96/122

[58] Field of Search ..... 96/122, 66 R, 139, 140, 96/95

[56] References Cited

U.S. PATENT DOCUMENTS

| | | | |
|---|---|---|---|
| 2,944,896 | 7/1960 | Riester | 96/139 |
| 3,573,914 | 4/1971 | Masseth | 96/66 |
| 3,895,948 | 7/1975 | Shiba et al. | 96/122 |

FOREIGN PATENT DOCUMENTS

| | | | |
|---|---|---|---|
| 918308 | 9/1954 | Fed. Rep. of Germany | 96/122 |

*Primary Examiner*—J. Travis Brown
*Attorney, Agent, or Firm*—Finnegan, Henderson, Farabow & Garrett

[57] ABSTRACT

A light-sensitive silver halide photographic material containing at least one compound selected from the compounds represented by the following general formula (I) and at least one compound selected from compounds represented by the following general formula (II):

General formula (I)

wherein Z represents a non-metal atomic group necessary for forming a pyrroline, thiazoline or selenazoline ring, $Y_1$ represents oxygen, sulfur, selenium or an N-$R_3$ group (in which $R_3$ represents an alkyl-, alkenyl- or aryl-group), R represents hydrogen or lower alkyl, and $R_1$ and $R_2$ individually represent an alkyl-, alkenyl- or aryl-group; General formula (II)

wherein P represents (in which $R_5$ and $R_6$ individually represent an alkyl-, alkenyl- or aryl-group), $Y_2$ represents oxygen, sulfur, selenium, or an >N-$R_7$ group (in which $R_7$ represents an alkyl-, alkenyl- or aryl-group), and $R_4$ represents an alkyl-, alkenyl- or aryl-group.

6 Claims, 3 Drawing Figures

LIGHT-SENSITIVE SILVER HALIDE PHOTOGRAPHIC MATERIALS

Figure 1:
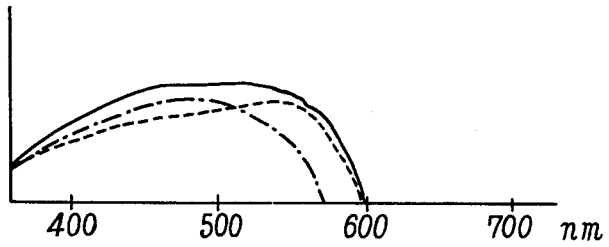

This invention relates to a light-sensitive silver halide photographic material subjected to optical supersensitization.

It has heretofore been well known to prepare spectrally sensitized light-sensitive silver halide photographic materials by use of merocyanine dyes and also to prepare optical supersensitized light-sensitive silver halide photographic materials by the combination use of two or more kinds of sensitizing dyes.

Hitherto, the merocyanine dyes have been known to have such excellent properties that they have a capacity of strongly adsorbing silver halide particles, are difficultly affected by coexisting other organic substances with respect to their spectral sensitization effects and less stained with sensitizing dyes remaining after development treatment. The merocyanine dyes, however, have such drawback that they scarcely produce optical supersensitization effect even when they are used in combination with other sensitizing dyes.

The present inventors made an intensive and extensive study of the preparation of a light-sensitive silver halide photographic material having optical supersensitization effects by utilizing the superior aspects of the merocyanine dyes.

A primary object of the present invention is to provide a novel light-sensitive silver halide photographic material which has been optically supersensitized and is high in spectral sensitivity as a result. A second object of the present invention is to provide a novel light-sensitive silver halide photographic material having improved property of stability against a lapse of time as to photographic characteristics.

It has now been found that the above-mentioned objects are attained by incorporating, into a light-sensitive silver halide photographic material, at least one member selected from compounds represented by the following general formula [I] and at least one member selected from compounds represented by the following general formula [II].

General formula [I]

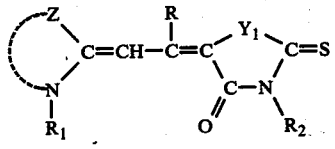

wherein Z represents a non-metal atomic group necessary for forming a pyrroline-, thiazoline- or selenazoline-ring, $Y_1$ represents oxygen, sulfur, selenium or an $>N-R_3$ group (in which $R_3$ represents an alkyl-, alkenyl- or aryl-group), R represents hydrogen or lower alkyl, and $R_1$ and $R_2$ individually represent an alkyl-, alkenyl- or aryl-group.

General formula [II]

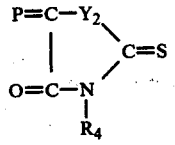

wherein P represents

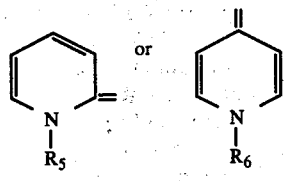

(in which $R_5$ and $R_6$ individually represent an alkyl-, alkenyl- or aryl-group), $Y_2$ represents oxygen, sulfur, selenium or an $>N-R_7$ group (in which $R_7$ represents an alkyl-, alkenyl- or aryl-group), and $R_4$ represents an alkyl-, alkenyl- or aryl-group.

The alkyl group represented by each of the aforementioned $R_1$-$R_7$ includes alkyl and substituted alkyl. The alkyl is preferably lower alkyl having 1 to 3 carbon atoms. The substituted alkyl preferably includes, for example, carboxyalkyl and the salt thereof, sulfoalkyl and its salt, hydroxyalkyl, alkoxycarbonylalkyl, acyloxyalkyl, halogen-substituted alkyl, phenoxyalkyl and arylalkyl. The aryl group represented by each of the aforementioned $R_1$-$R_7$ includes aryl and substituted aryl. The aryl is preferably phenyl. The substituted aryl preferably includes, for example, halogen-substituted aryl, sulfo-substituted aryl and its salt, and carboxy-substituted aryl and its salts. The lower alkyl represented by R having preferably 1 to 2 carbon atoms.

The alkenyl group for each of the aforementioned $R_1$-$R_7$ includes alkenyl and substituted alkenyl. Allyl is more preferred in the alkenyl.

An essential feature of the present invention resides in that by virtue of the combination use of specific compounds represented respectively by the aforementioned general formulas [I] and [II] (hereinafter frequently called "the present compounds"), not only the aforesaid excellent characteristic properties of merocyanine dyes but also the so-called optical supersensitization effect can be imparted to the resulting light-sensitive silver halide photographic material, which optical supersensitization effect could not be obtained by the use of a compound represented by the general formula [I] alone or a compound represented by the general formula [II] alone. Another feature of the present invention is in that the combination use of the present compounds displays a particularly excellent effect in the case of silver chloroiodobromide emulsions containing less than 5 mole% of silver iodide and more than 50 mole% of silver chloride and having an average particle diameter of 0.1–0.6$\mu$ of silver halide, though the present compounds may be effectively used in any silver halide emulsions.

Such features as set forth above are considered ascribable to specific chemical structures of the present compounds.

Further, in the case where a compound of the general formula [I], in which Z represents a non-metal atomic group necessary for forming a pyrroline ring and $Y_1$ represents sulfur, is used in combination with a compound of the general formula [II] and in the case where a compound of the general formula [II], in which $Y_2$ represents sulfur, is used in combination with a compound of the general formula [I] in a light-sensitive silver halide photographic material, particularly excellent stability is observed in the resulting light-sensitive silver halide photographic material. In addition, particularly preferable combinations of the present compounds include such instances where a compound of the general formula [I], in which Z represents a non-metal atomic group necessary for forming a pyrroline ring and $Y_1$ represents sulfur, is used in combination with a compound of the general formula [II], in which $Y_2$ represents sulfur. In such instance, when a light-sensitive silver halide photographic material comprising a silver chloroiodobromide emulsion containing less than 5 mole% of silver iodide and more than 50 mole% of silver chloride and having an average silver halide particle diameter of 0.1–0.6μ is processed with the so-called lith-type developer (infectious developer) solution containing an adduct formaldehyde with sodium sulfite, the processing time may be shortened and an image of preferable dot quality may be obtained.

Concrete examples of the present compounds are exemplified below, but the present compounds are not limited only to those as exemplified.

Concrete examples of the compound of the general formula [I]:

(I) - (A)

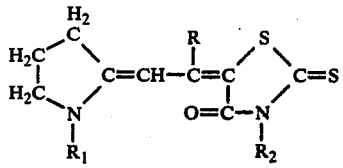

| Exemplified compound No. | R | $R_1$ | $R_2$ |
|---|---|---|---|
| 1 | $-CH_3$ | $-CH_3$ | $-CH_2CH_3$ |
| 2 | H | $-CH_3$ | $-CH_2COOH$ |
| 3 | H | $-CH_3$ | $-CH_2CH_2OH$ |
| 4 | H | $-CH_2CH_3$ | 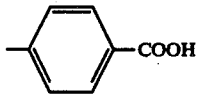 |
| 5 | H | $-CH_3$ | $-CH_2CH_2SO_3H$ |
| 6 | $-CH_2CH_3$ | $-CH_2CH_2SO_3Na$ | $-CH_2COOH$ |
| 7 | H | $-CH_2(CH_2)_2SO_3HN(C_2H_5)_3$ | $-CH_2CH_3$ |
| 8 | H | $-CH_3$ | $-CH_2CH{=}CH_2$ |

(I) - (B)

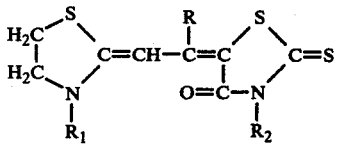

| Exemplified compound No. | R | $R_1$ | $R_2$ |
|---|---|---|---|
| 9 | H | $-CH_3$ | $-CH_2CH_3$ |
| 10 | $-CH_3$ | $-CH_3$ | $-CH_2COOH$ |
| 11 | H | $-CH_3$ | $-CH_2CH_2OH$ |
| 12 | H | $-CH_2CH_3$ | 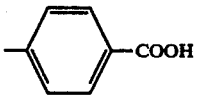 |
| 13 | H | $-CH_3$ | $-CH_2CH_2SO_3H$ |
| 14 | H | $-CH_2CH_2SO_3Na$ | $-CH_2COOH$ |
| 15 | H | $-CH_2(CH_2)_2SO_3HN(C_2H_5)_3$ | $-CH_2CH_3$ |
| 16 | H | $-CH_3$ | $-CH_2-CH{=}CH_2$ |

(I) - (C)

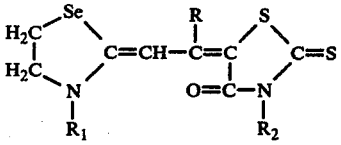

| Exemplified compound No. | R | $R_1$ | $R_2$ |
|---|---|---|---|
| 17 | H | $-CH_3$ | $-CH_2CH_3$ |
| 18 | H | $-CH_3$ | $-CH_2COOH$ |
| 19 | $-CH_2CH_3$ | $-CH_3$ | $-CH_2CH_2OH$ |
| 20 | H | $-CH_2CH_3$ | 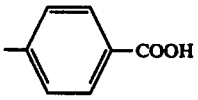 |
| 21 | H | $-CH_3$ | $-CH_2CH_2SO_3H$ |
| 22 | H | $-CH_2CH_2SO_3Na$ | $-CH_2COOH$ |
| 23 | H | $-CH_2(CH_2)_2SO_3HN(C_2H_5)_3$ | $-CH_2CH_3$ |
| 24 | H | $-CH_3$ | $-CH_2-CH{=}CH_2$ |

-continued (I) - (D)

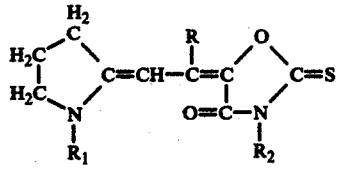

| Exemplified compound No. | R | $R_1$ | $R_2$ |
|---|---|---|---|
| 25 | $-CH_3$ | $-CH_3$ | $-CH_2CH_3$ |
| 26 | H | $-CH_3$ | $-CH_2COOH$ |
| 27 | H | $-CH_3$ | $-CH_2CH_2OH$ |
| 28 | H | $-CH_2CH_3$ | 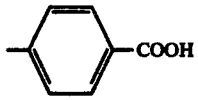 |
| 29 | H | $-CH_3$ | $-CH_2CH_2SO_3H$ |
| 30 | H | $-CH_2CH_2SO_3Na$ | $-CH_2COOH$ |
| 31 | H | $-CH_2(CH_2)_2SO_3HN(C_2H_5)_3$ | $-CH_2CH_3$ |
| 32 | H | $-CH_3$ | $-CH_2-CH=CH_2$ |

(I) - (E)

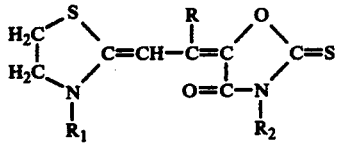

| Exemplified compound No. | R | $R_1$ | $R_2$ |
|---|---|---|---|
| 33 | H | $-CH_3$ | $-CH_2CH_3$ |
| 34 | H | $-CH_3$ | $-CH_2COOH$ |
| 35 | H | $-CH_3$ | $-CH_2CH_2OH$ |
| 36 | H | $-CH_2CH_3$ | 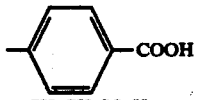 |
| 37 | H | $-CH_3$ | $-CH_2CH_2SO_3H$ |
| 38 | H | $-CH_2CH_2SO_3Na$ | $-CH_2COOH$ |
| 39 | H | $-CH_2(CH_2)_2SO_3HN(C_2H_5)_3$ | $-CH_2CH_3$ |
| 40 | $-CH_2CH_3$ | $-CH_3$ | $-CH_2-CH=CH_2$ |

(I) - (F)

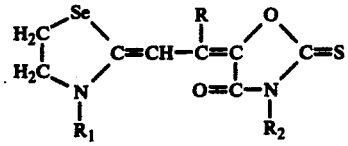

| Exemplified compound No. | R | $R_1$ | $R_2$ |
|---|---|---|---|
| 41 | H | $-CH_3$ | $-CH_2CH_3$ |
| 42 | H | $-CH_3$ | $-CH_2COOH$ |
| 43 | H | $-CH_3$ | $-CH_2CH_2OH$ |
| 44 | H | $-CH_2CH_3$ | 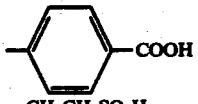 |
| 45 | H | $-CH_3$ | $-CH_2CH_2SO_3H$ |
| 46 | H | $-CH_2CH_2SO_3Na$ | $-CH_2COOH$ |
| 47 | H | $-CH_2(CH_2)_2SO_3HN(C_2H_5)_3$ | $-CH_2CH_3$ |
| 48 | H | $-CH_3$ | $-CH_2-CH=CH_2$ |

(I) - (G)

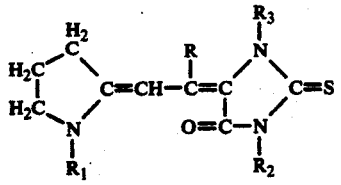

| Exemplified compound No. | R | $R_1$ | $R_2$ | $R_3$ |
|---|---|---|---|---|
| 49 | H | $-CH_3$ | 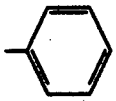 | $-CH_2CH_3$ |

-continued

| | | | | |
|---|---|---|---|---|
| 50 | H | $-CH_3$ | 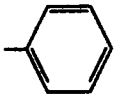 | $-CH_2COOH$ |
| 51 | H | $-CH_3$ | 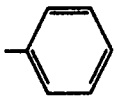 | $-CH_2CH_2OH$ |
| 52 | H | $-CH_3$ | $-CH_3$ | $-CH_3$ |
| 53 | H | $-CH_2(CH_2)_2SO_3H$ | $-CH_2CH_3$ | $-CH_2CH_3$ |

(I) - (H)

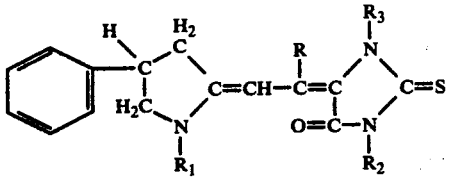

| Exemplified compound No. | R | $R_1$ | $R_2$ | $R_3$ |
|---|---|---|---|---|
| 54 | H | $-CH_3$ | 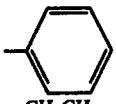 | $-CH_3$ |
| 55 | H | $-CH_2CH_3$ | $-CH_2CH_3$ | $-CH_2COOH$ |
| 56 | H | $-CH_2CH_3$ | $-CH_2CH_3$ | 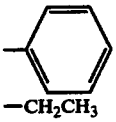 |
| 57 | H | $-CH_2(CH_2)_2SO_3Na$ | $-CH_2CH_3$ | $-CH_2CH_3$ |
| 58 | H | $-CH_2(CH_2)_2SO_3Na$ | $-CH_2CH_3$ | 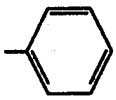 |

(I) - (I)

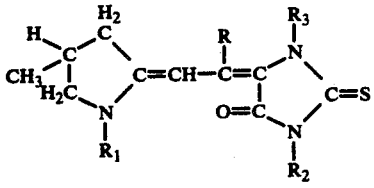

| Exemplified compound No. | R | $R_1$ | $R_2$ | $R_3$ |
|---|---|---|---|---|
| 59 | H | $-CH_3$ | 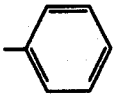 | $-CH_3$ |
| 60 | H | $-CH_2CH_3$ | $-CH_2CH_3$ | $-CH_2COOH$ |
| 61 | H | $-CH_2CH_3$ | $-CH_2CH_3$ | 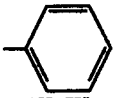 |
| 62 | H | $-CH_2(CH_2)_2SO_3Na$ | $-CH_2CH_3$ | $-CH_2CH_3$ |
| 63 | H | $-CH_2(CH_2)_2SO_3Na$ | $-CH_2CH_3$ | 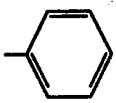 |

Concrete examples of the compound of the general formula (II):

(II) - (A)

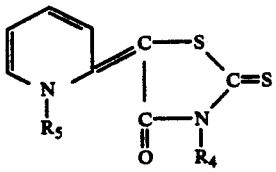

| Exemplified compound No. | $R_5$ | $R_4$ |
|---|---|---|
| 101 | $-CH_3$ | $-CH_2-CH=CH_2$ |

-continued

| | | |
|---|---|---|
| 102 | $-CH_2CH_3$ | $-CH_2CH_3$ |
| 103 | $-CH_2CH_3$ | 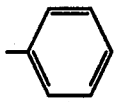 |
| 104 | $-CH_3$ | $-CH_2COOH$ |
| 105 | $-CH_2CH_3$ | $-CH_2CH_2OH$ |
| 106 | $-CH_3$ | $-CH_2CH_2SO_3K$ |
| 107 | $-CH_3$ | 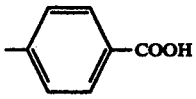 |
| 108 | $-CH_2CH_2CH_3$ | 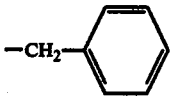 |

(II) - (B)

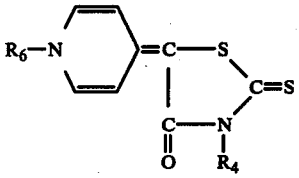

| Exemplified compound No. | $R_6$ | $R_4$ |
|---|---|---|
| 109 | $-CH_3$ | $-CH_2CH_3$ |
| 110 | $-CH_2CH_3$ | 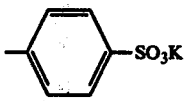 |
| 111 | $-CH_3$ | $-CH_2CH_2OH$ |
| 112 | $-CH_3$ | $-CH_2CH_2COOH$ |
| 113 | $-CH_2(CH_2)_2SO_3K$ | $-CH_2CH_3$ |
| 114 | $-CH_2CH_2OH$ | $-CH_2CH_3$ |
| 115 | 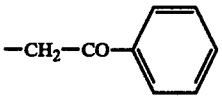 | $-CH_2CH_3$ |
| 116 | $-CH_2COOCH_2CH_3$ | $-CH_2CH_3$ |

(II) - (C)

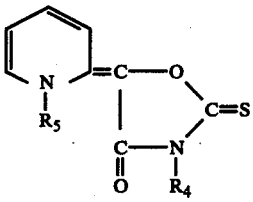

| Exemplified compound No. | $R_5$ | $R_4$ |
|---|---|---|
| 117 | $-CH_3$ | $-CH_2CH_3$ |
| 118 | $-CH_3$ | $-CH(CH_3)_2$ |
| 119 | $-CH_2CH_3$ | $-CH_2CH_2OH$ |
| 120 | $-CH_3$ | $-CH_2CH_2OCOCH_2CH_3$ |
| 121 | $-CH_3$ | $-CH_2CH_2SO_3K$ |

(II) - (D)

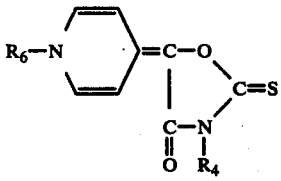

| Exemplified compound No. | $R_6$ | $R_4$ |
|---|---|---|
| 122 | $-CH_2CH_3$ | $-CH_2CH_3$ |
| 123 | $-CH_3$ | 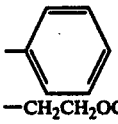 |
| 124 | $-CH_3$ | $-CH_2CH_2OCOCH_3$ |

-continued

| | | |
|---|---|---|
| 125 | $-CH_3$ | $-CH_2CH_2SO_3K$ |

(II) - (E)

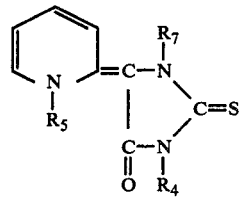

| Exemplified compound No. | $R_5$ | $R_7$ | $R_4$ |
|---|---|---|---|
| 126 | $-CH_2CH_3$ | $-CH_2CH_3$ | $-CH_2CH_3$ |
| 127 | $-CH_3$ | 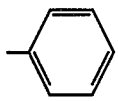 | $-CH_2CH_3$ |
| 128 | $-CH_3$ | 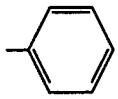 | $-CH_2COOH$ |

The typical examples of the present compounds exemplified above may be synthesized in accordance with such procedure, for example, as disclosed in British Pat. No. 450,958, U.S. Pat. No. 2,519,001 and West German Pat. No. 883,025.

The present compounds may be incorporated into a silver halide emulsion after dissolving them in an organic solvent (e.g. methanol, ethanol, fluorinated alcohol, etc.) which is soluble in water. The present compounds may be incorporated into a silver halide emulsion at any time during the step of preparing the emulsion, but the incorporation is preferably carried out during the period after completion of second ripening and before coating the emulsion.

The total amount of the present compounds to be added is usually within the range of from 10 to 1,000 mg per 1 mole of silver halide, preferably from 30 to 200 mg, though said amount may vary depending on the kind of the present compounds, the kind of the combination of the present compounds, and the kind of silver halide, and further on the purposes for which the resulting light-sensitive silver halide photographic material is used. In that case, the weight ratio of the present compound of the general formula [I] to the present compound of the general formula [II] may be within the range from 1:10 to 10:1, preferably from 1:3 to 3:1.

Effectively usable as silver halide in the light-sensitive silver halide photographic material of the present invention, are silver chloride, silver bromide, silver iodide, silver chlorobromide, silver chloroiodide, silver iodobromide and silver chloroiodobromide and the mixtures of these silver halides in optional proportions. Among these silver halides, silver chloroiodobromide containing less than 5 mole% of silver iodide and more than 50 mole% of silver chloride is preferable. Particle diameter of the silver halide may be of either usual size or fine grain size. However, the silver halide having an average particle diameter of 0.04 to 2$\mu$ is preferable, and particularly preferred are those having an average particle diameter of 0.1 to 0.6$\mu$. Silver halide having any crystal form, either crystal system of octahedron or hexahedron, may be usable in the present invention. The silver halide crystal may contain therein iridium, rhodium, osmium, cobalt or bismuth atom. The silver halide particle may have any crystal structure, such as a crystal structure of which the interior is uniform, a crystal structure of which the interior is qualitatively different from the exterior to form a layer-structure and a so-called conversion type crystal structure disclosed in British Pat. No. 635,841 or U.S. Pat. No. 3,622,318. The silver halide usable in the present invention may be of a surface latent image type or internal latent image type.

Further, the emulsion containing these silver halides may be incorporated with usually used various photographic addenda as far as they do not hinder the effect of the present invention. As sensitizer, there may be used, for example, active gelatin, sulfur sensitizers (e.g. sodium thiosulfate, allylthiocarbamide, thiourea, allylisothiacyanate, etc.), selenium sensitizers (e.g. N,N-dimethylselenourea, selenourea, etc.), reduction sensitizers (e.g. triethylenetetramine, trichloride, etc.), and noble metal sensitizers, for example gold sensitizers (e.g. potassium chloroaurite, potassium aurithiocyanate, potassium chloroaurate, 2-aurosulfobenzothiazolemethyl chloride, etc.) and, in addition thereto, sensitizers of paladium, platinum and iridium (e.g. ammonium chloropaladate, potassium chloroplatinate, sodium chloropaladate, etc.) may be used in combination therewith.

Usable stabilizers include such compounds as disclosed in Japanese Patent Publications Nos. 2825/1964, 4133/1968, 4417/1972 and 13566/1974, U.S. Pat. Nos. 2,444,607, 2,716,062, 3,342,596 and 3,512,982, West German Pat. Nos. 1,189,380, 2,058,626, 2,118,411 and 2,149,789.

As particularly preferable stabilizer compounds, there may be mentioned 5,6-trimethylene-7-hydroxy-S-triazolo (1.5-a)pyrimidine, 5,6-tetramethylene-7-hydroxy-S-triazolo(1.5-a)pyrimidine, 5-methyl-7-hydroxy-S-triazolo(1.5-a)pyrimidine, 7-hydroxy-S-triazolo(1.5-a) pyrimidine, 5-methyl-6-bromo-7-hydroxy-S-triazolo(1.5-a) pyrimidine, gallic acid esters (e.g. propylgallate and sodium gallate), mercaptans (1-phenyl-5-mercaptotetrazole and 2-mercaptobenzthiazole) benztriazoles (5-bromobenztriazole and 4-methylbenztriazole) and benzimidazoles (6-nitrobenzimidazole).

As sensitizing dyes which may be effectively used with the combination of the present compounds, there may be mentioned, for example methine dyes such as cyanine dyes, merocyanine dyes, hemicyanine dyes, rhodacyanine dyes, oxonol dyes and hemioxonol dyes, and styryl dye. Such dyes as disclosed in the following known references may also be used.

Japanese Laid-Open-to-Public Patent Publications Nos. 28224/1973 and 78930/1973, Japanese Patent Publications Nos. 10251/1968, 10252/1968, 13821/1968, 32753/1969, 27672/1970 to 27675/1970, 18106/1971, 18108/1971, 8742/1972, 23573/1972 and 37443/1972, U.S. Pat. Nos. 1,846,301, 1,846,320, 1,939,201, 1,990,507, 2,072,908, 2,112,140, 2,165,338, 2,269,234, 2,270,378, 2,442,710, 2,443,748, 2,454,629, 2,503,776, 2,519,001, 2,666,761, 2,739,149, 2,739,964 and 2,945,768, British Pat. Nos. 424,559, 438,420, 450,958 and 505,979, West German Patents 929,080 and 2,449,967, and Mees/James, "The theory of the Photographic process", 3rd Edition (1966) and Hamar, Cyanindyes and related Compound (1964).

Effectively usable as surface active agents in the light-sensitive silver halide photographic material of the present invention, are those disclosed in Japanese Laid-Open-to-Public Patent Publications Nos. 18338/1972, 20785/1973 and 46733/1974, Japanese Patent Publication Nos. 376/1965, 13166/1968, 17922/1968, 17926/1968, 43130/1968 and 26580/1969, U.S. Pat. Nos. 3,026,202 and 3,514,293, French Pat. No. 2,025,668, and Belgian Pat. 773,459. Particularly preferably usable surface active agents include, for example, saponin, polyethylene glycol, alkylphenoxy polyethylene glycol, alkylphenoxy polyglycidol, cane sugar fatty acid esters, nonionic surface active agents having organosiloxane, anionic surface active agents such as sodium-alkyl-sulfosuccinate (e.g. sodium-di-2-ethylhexyl-sulfosuccinate, etc.), sodium alkylbenzenesulfonate (e.g. sodium dodecylbenzenesulfonate, etc.), sodium alkylnaphthalenesulfonate (e.g. sodium triisopropylnaphthalenesulfonnate, etc.), sodium naphthalenesulfonate and polymers thereof, amphoteric surface active agents such as sodium-alkyl-phenoxypolyethyleneglycol sulfonate (e.g. sodium-p-t-octylphenoxypolyethyleneglycol sulfonate, etc.) and N-alkyl-N,N-dipolyoxyethylene-N-carboxymethylbetain (e.g. N-lauryl-N,N-dipolyoxyethylene-N-carboxymethyl-betain, etc.), and surface active agents having fluorine-containing alkyl groups of nonionic, anionic cationic or betain type (e.g. FC-134, FC-172 produced and sold by 3 M Co., Ltd.). These surface active agents may be used either singly or in combination of several agents.

As gelatin hardening agents usable in the light-sensitive silver halide photographic material of the present invention, there may be mentioned, for example, those of aldehyde and aziridine type (e.g. those as disclosed in PB Report No. 19921, Japanese Patent Publication No. 40898/1971, U.S. Pat. Nos. 2,950,197, 2,964,404, 2,983,611 and 3,271,175), of isooxazole type (e.g. those as disclosed in U.S. Pat. No. 3,316,095), of epoxy type (e.g. those as disclosed in Japanese Patent Publication No. 35495/1973, U.S. Pat. No. 3,047,394, West German Pat. No. 1,085,663 and British Pat. No. 1,033,518) of vinyl sulfone type (e.g. those as disclosed in PB Report No. 19920, West German Pat. No. 1,100,942, British Pat. No. 1,251,091, U.S. Pat. Nos. 3,490,911 and 3,539,644, Japanese Laid-Open-to-Public Patent Publications Nos. 62250/1975 and 67640/1975 and Japanese Patent Publication No. 13563/1974), of acryloyl type (e.g. those as disclosed in Japanese Laid-Open-to-Public Patent Publication No. 116154/1974 and U.S. Pat. No. 3,640,720), of carbodiimide type (e.g. those as disclosed in Japanese Laid-Open-to-Public Patent Publication No. 109251/1975, Japanese Patent Publication No. 38715/1971 and U.S. Pat. No. 2,938,892), of maleimide type (e.g. those as disclosed in U.S. Pat. Nos. 2,992,109 and 3,232,763), of acetylene type (e.g. those as disclosed in West German Pat. No. 2,130,485), methanesulfonic acid ester type (e.g. those as disclosed in U.S. Pat. Nos. 2,726,162 and 3,110,597, and Japanese Laid-Open-to-Public Patent Publication No. 118744/1974), of high molecular compound type (e.g. those as disclosed in U.S. Pat. No. 3,058,827, British Pat. Nos. 822,061, 1,049,083, 1,202,052 and 1,230,354, and of triazine type (e.g. those as disclosed in Japanese Laid-Open-to-Public Patent Publication No. 61219/1975 and U.S. Pat. No. 3,288,775). Of these hardeners mentioned above, those which are particularly effectively usable are formaldehyde, mucochloric acid, glyoxal, 1,3,5-triacryl-1,3,5-triazine, monomethylol-dimethyl-hydantoin, 1,3-dimethanesulfonyl propane, divinylsulfonylethane and 1,2-propyleneglycoldiglycidyl ether.

Usable as latices in the light-sensitive silver halide photographic material of the present invention, are copolymers of acrylic ester or vinyl ester with other monomers having vinyl groups, which are disclosed in Japanese Patent Publication No. 43125/1973, U.S. Patent 2,956,884 and French Pat. No. 1,395,544. Plasticizers usable in the light-sensitive silver halide photographic material of the present invention include glycerine and such compounds as disclosed in Japanese Patent Publications Nos. 4939/1968 and 15462/1970, Japanese Laid-Open-to-Public Patent Publication No. 63715/1973, U.S. Pat. No. 2,960,404, West German Pat. No. 1,904,604 and Belgian Pat. No. 762,833.

Usable as thickeners in the light-sensitive silver halide photographic material of the present invention, are styrene-sodium maleate copolymers, alkylvinyl ether-maleic acid copolymers and compounds disclosed in U.S. Pat. No. 3,767,410 and Belgian Pat. No. 558,143.

The light-sensitive silver halide photographic material of the present invention may also be incorporated with ethylenediaminetetraacetic acid and metal ion-blocking agents disclosed in U.S. Pat. No. 3,236,652, West German Pat. Nos. 1,170,777 and 1,187,132, and Japanese Laid-Open-to-Public Patent Publications Nos. 3620/1975 and 25218/1975.

Further, development accelerators preferably used in processing the light-sensitive silver halide photographic material of the present invention or contrasting agents preferably used in infectious developer include polyoxyethylene type compounds and such compounds as disclosed, for example, in Journal of the Photographic Science, Dec. 5, 1954, and N. W. Wood, "On the effect of polyethyleneoxide on Hydroquinone Development".

In the processing of the light-sensitive photographic material of the present invention, alkylene oxide polymers may be used. Alkylene oxide polymers are such condensation products of alkylene oxides with glycols of 8 to 18 carbon atoms as disclosed in U.S. Pat. No. 2,240,472 and British Pat. No. 443,559, such condensation products of alkylene oxide with aliphatic alcohols, with such fatty acids, e.g. as lauric acid and glycine, with such fatty acid amines or fatty acid amides, e.g. as glycine or laurylamide or with phenols as disclosed in U.S. Pat. No. 1,970,578, and such dehydrated products of alkylene oxides with hexynol as disclosed in U.S. Pat. No. 2,400,532.

Further, there may also be used such compounds as disclosed in West German Pat. No. 1,122,834, British Pat. No. 805,826, and Japanese Patent Publications Nos. 6475/1956, 10245/1968, 13822/1968 and 18009/1972.

In case the light-sensitive silver halide photographic material of the present invention is used as a so-called lith type photographic film, there may also be used, in infectious developer for the purposes of improving infectious development characteristics and of increasing sensitivity, quaternary ammonium salts (disclosed in U.S. Pat. Nos. 2,271,623 and 2,944,898, Japanese Laid-Open-to-Public Patent Publications Nos. 59827/1973 and 123022/1974, Japanese Patent Publications Nos. 21186/1971 and 11116/1972), for example, 1-phenyl-2-mercaptotetrazole, 2-mercaptobenzoxazole, 2-mercaptobenzthiazole, 2-mercaptobenzimidazole, 2-mercapto-5-nitrobenzimidazole, 2-phenylbenzimidazole, benztriazole, 4-mercaptopyrimidine, 2,3-dihydroxy-5-mercaptopyrimidine and 5-nitrobenzimidazole.

Effectively usable as binders in the light-sensitive silver halide photographic material of the present invention are, for example, gelatin, colloidal albumin, agar, gum arabic, alginic acid, hydrolyzed cellulose acetate, acrylamide, imidized polyamide, polyvinyl alcohol, hydrolyzed polyvinylacetate and such water-soluble polymers as disclosed in British Pat. 523,661, West German Patents Nos. 2,046,682 and 2,255,711 and gelatin derivatives (e.g. phenylcarbamyl gelatin, acylated gelatin and phthalated gelatin disclosed in U.S. Pat. Nos. 2,525,753 and 2,614,928, or gelatin derivatives disclosed in U.S. Pat. Nos. 2,548,520 and 2,831,767 which are prepared by grafting on gelatin a polymerizable monomer having ethylene group such as acrylic ester, methacrylic acid, methacrylic ester and the like).

Usable as supports in the light-sensitive silver halide photographic material of the present invention are, for example, baryta paper, polyethylene-coated paper, polypropylene synthetic paper, glass plate, cellulose acetate film, cellulose nitrate film, polyester film such as polyethylene terephthalate film, polyamide film, polypropylene film, polycarbonate film, polystyrene film and the like, and a desired support may be suitably selected from these materials according to the purposes for which the resulting light-sensitive silver halide photographic material is used.

The light-sensitive silver halide photographic material of the present invention may be processed with a developer solution in conformity with the purpose for which said photographic material is used. As principal constituents of the developer solution, there may be mentioned dihydroxybenzene derivatives (e.g. hydroquinone, chlorohydroquinone, bromohydroquinone, isopropylhydroquinone, methylhydroquinone, 2,3-dichlorohydroquinone, 2,5-dimethylhydroquinone, 2,3-dibromohydroquinone, 1,4-dioxy-2-acetophenone-2,5-dimethylhydroquinone, 2,5-dimethylhydroquinone, 2,5-di-p-phenethylhydroquinone, 2,5-dibenzoylaminohydroquinone, 2,5-acetoaminohydroquinone and their esters), paraphenylenediamine derivatives (e.g. p-amino-N-ethyl-N-$\beta$-(methanesulfonamidoethyl)-m-toluidinesesquisulfatemonohydrate, diethylamino-p-phenylenediaminesesquisulfite, p-amino-N,N-diethyl-m-toluidinehydrochloride, p-amino-N-ethyl-n-$\beta$-hydroxyethylaniline sesquisulfate monohydrate and the like), formaldehyde bisulfite-amine condensation products (e.g. sodium-2-oxyethylaminomethane sulfonate, sodium-1,1-dimethyl-2-oxyaminomethane sulfonate, sodium-1,1-bis(oxymethyl)ethylaminomethane sulfonate, sodium-tris(oxymethyl)methylaminomethane sulfonate, sodium-3-oxypropylaminomethane sulfonate, sodium-bis(2-oxyethyl)aminomethane sulfonate, sodium-N,N-bis(2-[1-oxy]-propyl)aminomethane sulfonate, sodium-N-isopropyl-N-(2-oxyethyl)aminomethane sulfonate, sodium-N-ethyl-N-(2-oxyethyl)aminomethane sulfonate and the like) and free amines (e.g. 2-aminoethanol, 1-amino-2-propanol, 2-amino-2-methyl-1-propanol, 2-amino-2-methyl-1,3-propanediol, 2-amino-(2-oxymethyl)-1,3-propanediol, 3-amino-1-propanol, 2,2'-dioxydiethylamine, diisopropanolamine, 2-isopropylaminoethanol, 2-ethylaminoethanol, 2-methylaminoethanol, triethanolamine and the like).

The preferred conditions under which the light-sensitive silver halide photographic material of the present invention can be processed after imagewise exposure include the processing temperature of 20°-55° C. and the processing time of from 10 seconds to 3 minutes, and the treatment process disclosed, for example, in Japanese Patent Publication No. 5574/1976, may also be effectively applicable to the processing of the exposed photographic material of the present invention.

The light-sensitive silver halide photographic materials of the present invention may be usable for various purposes, and more concretely they can be used as light-sensitive silver halide photographic materials of common negative type, common reversal type, common positive type, color negative type, color positive type and color reversal type and as materials for roentgenographic, photolithographic and microphotographic purposes.

The present invention is concretely illustrated below with reference to examples, but the scope of technical idea on which the invention is based is not limited only to these examples.

Example 1

A silver iodobromide emulsion (containing 7 mole% of silver iodide) prepared by double jet process was subjected to physical ripening and then to desalting treatment to prepare a silver halide emulsion. The silver halide thus prepared had an average particle diameter of 0.8$\mu$, and more than 80% of the silver halide particles were of regular octahedron system. 1 Kilogram of this emulsion had a silver halide content of 1.2 moles. 1 Kilogram of this emulsion was subjected in an vessel, to chemical sensitization by use of a gold sensitizer and a sulfur sensitizer. After chemical sensitization, the emulsion was divided into portions. To one of the divided portions was added a solution of comparative sensitizing dye [A] ($1.5 \times 10^{-4}$ mole/1 kg emulsion) in methanol and then were added successively a 1% aqueous solution of 4-hydroxy-6-methyl-1,3,3a,7-tetrazaindene (80 cc/1 kg emulsion), a 1% aqueous solution of mucochloric acid (60 cc/1 kg emulsion) and a 1% aqueous solution of saponin (200 cc/1 kg emulsion) to prepare a sample emulsion. Subsequently, this sample emulsion was coated on a subbed cellulose triacetate base and then dried to prepare sample No. 1 (dry film thickness: 5$\mu$).

Using each of the compounds shown in Table 1 in place of the comparative sensitizing dye [A], the same procedure as above was repeated to obtain samples Nos. 2-39. After cutting each of these samples into a size suitable for measurement, the sample was subjected to wedgewise exposure, development, stopping, fixing and water-washing to obtain a strip having thereon a black-and-white image.

Exposure conditions: A light source having a color temperature of 5400° K was used, a blue filter (Wratten No. 47 B, a product of Eastman Kodak Co.) was used in combination with a green filter (Wratten No. 58 B, a product of Eastman Kodak Co.), and illumination employed was 64 luces for 1/50 seconds.

| Developer solution: | | |
|---|---|---|
| Monomethyl-p-aminophenol | 3 | g |
| Hydroquinone | 6 | g |
| Sodium carbonate (monohydrate) | 29.5 | g |
| Anhydrous sodium sulfite | 50 | g |
| Potassium bromide | 1 | g |
| Water to make | 1 | liter |

The strips having thereon a black-and-white image were individually measured as to blue sensitivity (SB), green sensitivity (SG) and fog by use of a K.D Type densitometer (manufactured by Konishiroku Photo Industry Co., Ltd.) to obtain the results as shown in Table 1, where the values of SB and SG of each sample were represented by relative values as measured by assuming as 100 the value of SG of the sample No. 1.

Separately, three samples, i.e. the samples Nos. 10–12, were individually subjected to a diffraction grating type spectral exposure apparatus using a light-source having a color temperature adjusted to 5400° K by means of a color temperature conversion filter to obtain spectrophotographs. The spectrophotographs thus obtained were individually subjected to development under the same conditions as above. The three samples thus developed were individually measured in spectral sensitivity to obtain the results as shown in the accompanying FIG. 1.

Table 1

| Sample No. | Dye added | Amount dye added $\times 10^{-4}$ mole /1 kg emulsion | SB | SG | Fog |
|---|---|---|---|---|---|
| 1 | Comparative sensitizing dye (A)* | 1.5 | 60 | 100 | 0.09 |
| 2 | Comparative sensitizing dye (B)* | 1.5 | 65 | 40 | 0.08 |
| 3 | Comparative sensitizing dye (A)<br>Comparative sensitizing dye (B) | 1.5<br>1.5 | 85 | 100 | 0.09 |
| 4 | Exemplified compound No. 1 | 1.5 | 65 | 75 | 0.08 |
| 5 | Exemplified compound No. 119 | 1.5 | 60 | 30 | 0.08 |
| 6 | Exemplified compound No. 1<br>Exemplified compound No. 119 | 1.5<br>1.5 | 115 | 115 | 0.11 |
| 7 | Exemplified compound No. 10 | 1.5 | 55 | 90 | 0.10 |
| 8 | Exemplified compound No. 106 | 1.5 | 60 | 25 | 0.10 |
| 9 | Exemplified compound No. 10<br>Exemplified compound No. 106 | 1.5<br>1.5 | 120 | 130 | 0.12 |
| 10 | Exemplified compound No. 7 | 1.5 | 45 | 85 | 0.12 |
| 11 | Exemplified compound No. 111 | 1.5 | 70 | 30 | 0.12 |
| 12 | Exemplified compound No. 7<br>Exemplified compound No. 111 | 1.5<br>1.5 | 110 | 140 | 0.14 |
| 13 | Exemplified compound No. 24 | 1.5 | 40 | 80 | 0.08 |

Table 1-continued

| Sample No. | Dye added | Amount dye added $\times 10^{-4}$ mole /1 kg emulsion | SB | SG | Fog |
|---|---|---|---|---|---|
| 14 | Exemplified compound No. 125<br>Exemplified compound No. 24 | 1.5<br>1.5 | 60 | 35 | 0.12 |
| 15 | Exemplified compound No. 125 | 1.5 | 120 | 135 | 0.12 |
| 16 | Exemplified compound No. 37 | 1.5 | 45 | 70 | 0.09 |
| 17 | Exemplified compound No. 128<br>Exemplified compound No. 37 | 1.5<br>1.5 | 50 | 30 | 0.08 |
| 18 | Exemplified compound No. 128 | 1.5 | 100 | 120 | 0.08 |
| 19 | Exemplified compound No. 54 | 1.5 | 40 | 95 | 0.11 |
| 20 | Exemplified compound No. 121<br>Exemplified compound No. 54 | 1.5<br>1.5 | 75 | 35 | 0.08 |
| 21 | Exemplified compound No. 121 | 1.5 | 120 | 150 | 0.09 |
| 22 | Exemplified compound No. 57 | 1.5 | 45 | 90 | 0.08 |
| 23 | Exemplified compound No. 104<br>Exemplified compound No. 57 | 1.5<br>1.5 | 60 | 25 | 0.06 |
| 24 | Exemplified compound No. 104 | 1.5 | 110 | 120 | 0.07 |
| 25 | Exemplified compound No. 60 | 1.5 | 45 | 110 | 0.08 |
| 26 | Exemplified compound No. 116<br>Exemplified compound No. 60 | 1.5<br>1.5 | 50 | 30 | 0.10 |
| 27 | Exemplified compound No. 116 | 1.5 | 110 | 150 | 0.10 |
| 28 | Exemplified compound No. 5 | 1.5 | 30 | 95 | 0.12 |
| 29 | Exemplified compound No. 125<br>Exemplified compound No. 5 | 1.5<br>1.5 | 65 | 30 | 0.10 |
| 30 | Exemplified compound No. 125 | 1.5 | 120 | 130 | 0.10 |
| 31 | Exemplified compound No. 12 | 1.5 | 45 | 100 | 0.09 |
| 32 | Exemplified compound No. 119<br>Exemplified compound No. 12 | 1.5<br>1.5 | 70 | 25 | 0.12 |
| 33 | Exemplified compound No. 119 | 1.5 | 115 | 140 | 0.12 |
| 34 | Exemplified compound No. 31 | 1.5 | 40 | 90 | 0.09 |
| 35 | Exemplified compound No. 101<br>Exemplified compound No. 31 | 1.5<br>1.5 | 65 | 35 | 0.08 |
| 36 | Exemplified compound No. 101 | 1.5 | 120 | 140 | 0.09 |
| 37 | Exemplified compound No. 13 | 1.5 | 35 | 95 | 0.08 |
| 38 | Exemplified compound No. 126<br>Exemplified compound No. 13 | 1.5<br>1.5 | 70 | 25 | 0.08 |
| 39 | Exemplified | 1.5 | 120 | 130 | 0.09 |

Table 1-continued

| Sample No. | Dye added | Amount dye added $\times 10^{-4}$ mole /1 kg emulsion | SB | SG | Fog |
|---|---|---|---|---|---|
| | compound No. 126 | | | | |

*Comparative sensitizing dye (A)

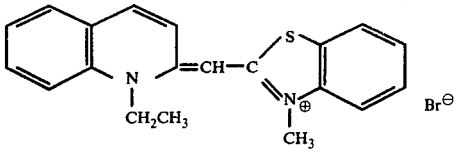

*Comparative sensitizing dye (B)

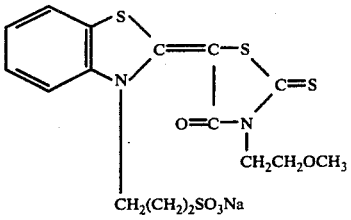

As is seen from Table 1, when the combination of the present compounds of the general formulas [I] and [II] was used in a light-sensitive silver halide photographic material, not only the material having a high photographic speed can be obtained which photographic speed could not be obtained when said compounds were used singly, but also the material having a sufficient photographic speed can be obtained even when compared with such photographic material (the sample No. 3) as obtained by the use of the combination of conventionally known sensitizing dyes.

Further, as can be observed from FIG. 1, the combination of the present compounds (the sample No. 12) shows optical supersensitization effect. Similar optical supersensitization effect to that of the sample No. 12 is observed in the samples Nos. 6, 9, 15, 18, 21, 24, 27, 30, 33, 36 and 39.

EXAMPLE 2

A silver chloroiodobromide emulsion (containing 0.5 mole% of silver iodide and 20 mole% of silver bromide) prepared by double jet process was subjected to physical ripening and then to desalting treatment to prepare a silver halide emulsion. An average particle diameter of the thus prepared silver halide emulsion was 0.4μ and more than 80% of the silver halide particles were of regular hexahedron system with a plane [1, 0, 0]. After subjecting to chemical ripening in the same manner as in Example 1, the emulsion was divided into portions. To one of the divided portions was added a solution of comparative sensitizing dye [A] ($1.5 \times 10^{-4}$ mole/1 kg emulsion) in methanol and were then added successively an aqueous solution of 4-hydroxy-6-methyl-1,3,3a,7-tetrazaindene (80 cc/1 kg emulsion), a 0.2% aqueous solution of a polyethylene oxide compound of an average molecular weight of 2000 (50 cc/1 kg emulsion), a 1% aqueous solution of monomethyloldimethyl hydantoin (200 cc/1 kg emulsion) and a 1% aqueous solution of sodium dodecylbenzenesulfonate (200 cc/1 kg emulsion) to prepare a sample emulsion. Subsequently, this sample emulsion was coated on a subbed polyethyleneterephthalate base and then dried to prepare a sample No. 1 (dry film thickness: 5μ). Using each of the compounds shown in Table 2 in place of comparative sensitizing dye [A], the same procedure as above was repeated to obtain samples Nos. 2–51.

After cutting into a size suitable for measurement, the samples thus prepared were individually subjected to wedgewise exposure, development, stopping, fixing aand water-washing to obtain strips having thereon a black-and-white image.

Exposure conditions: A light source having a color temperature of 5400° K was used, a blue filter (Wratten No. 47B, a product of Eastman Kodak Co.) was used in combination with a green filter (Wratten No. 58B, a product of Eastman Kodak Co.), and illumination employed was 125 luces. for 1 second.

Development conditions: Development was conducted at 30° C. for 1 minute and 30 seconds using the following developer solution.

| | | |
|---|---|---|
| Sodium formaldehyde bisulphite | 50 | g |
| Hydroquinone | 19 | g |
| Sodium carbonate | 80 | g |
| Boric acid | 10 | g |
| Potassium bromide | 2.2 | g |
| Water to make | 1 | liter |

The strips having thereon a black-and-white image were individually measured in blue filter sensitivity ($S_B$), green filter sensitivity ($S_G$) and fog by means of a K.D type densitometer manufactured by Konishiroku Photo Industry Co., Ltd.

The results obtained were as shown in Table 2, where the values of $S_B$ and $S_G$ of each sample were represented by relative values as measured by assuming as 100 the value of $S_G$ of the sample No. 1.

Subsequently, in order to investigate preservation characteristics, 17 kinds of samples, i.e. the samples Nos. 3, 6, 9, 12, 15, 18, 21, 24, 27, 30, 33, 36, 39, 42, 45, 48 and 51, were stored for 3 months under the conditions of 25° C. and 55% RH. Thereafter the 17 samples were individually subjected in the same manner as above to exposure, development treatment, etc. and then measured is $S_G$ and fog. The results obtained were as shown in Table 2, as well. In the table, the value of $S_G$ of each sample was represented by a relative value as measured likewise by assuming as 100 the value of $S_G$ of the sample No. 1.

Separately, three samples, i.e. the samples Nos. 19–21, were individually subjected to a diffraction grating type spectral exposure apparatus using a light source having a color temperature adjusted to 5400° K by means of a color temperature conversion filter to obtain spectrographs. The spectrographs thus obtained were individually subjected to development under the same conditions as above and then measured in spectral sensitivity to obtain the results as shown in the accompanying FIG. 2.

Further, in order to investigate high illumination-short time irradiation characteristics, each of the samples Nos. 1, 2, 3, 19, 20, 21, 37, 38 and 39 was subjected wedge exposure under the conditions of $10^5$ luces and $10^{-5}$ second and then to development treatment under the same conditions as above to obtain the results of measurement in speed as shown in Table 3.

Table 2

| | Amount of dye added | Stored for 2 months at |
|---|---|---|

Table 2-continued

| Sample No. | Dye added | x $10^{-4}$ mole /1 kg emulsion | $S_B$ | $S_G$ | Fog | 25° C, 35% RH $S_G$ | Fog |
|---|---|---|---|---|---|---|---|
| 1 | Comparative sensitizing dye (A)* | 1.5 | 50 | 100 | 0.04 | — | — |
| 2 | Comparative sensitizing dye (B)* | 1.5 | 70 | 40 | 0.04 | — | — |
| | Comparative sensitizing dye (A) | 1.5 | | | | | |
| 3 | | | 75 | 110 | 0.04 | 75 | 0.11 |
| | Comparative sensitizing dye (B) | 1.5 | | | | | |
| 4 | Exemplified compound No. 1 | 1.5 | 55 | 100 | 0.04 | — | — |
| 5 | Exemplified compound No. 101 | 1.5 | 75 | 40 | 0.03 | — | — |
| | Exemplified compound No. 1 | 1.5 | | | | | |
| 6 | | | 120 | 160 | 0.04 | 160 | 0.04 |
| | Exemplified compound No. 101 | 1.5 | | | | | |
| 7 | Exemplified compound No. 5 | 1.5 | 50 | 120 | 0.04 | — | — |
| 8 | Exemplified compound No. 104 | 1.5 | 90 | 40 | 0.04 | — | — |
| | Exemplified compound No. 5 | 1.5 | | | | | |
| 9 | | | 110 | 195 | 0.04 | 190 | 0.04 |
| | Exemplified compound No. 104 | 1.5 | | | | | |
| 10 | Exemplified compound No. 10 | 1.5 | 40 | 110 | 0.04 | — | — |
| 11 | Exemplified compound No. 106 | 1.5 | 75 | 50 | 0.04 | — | — |
| | Exemplified compound No. 10 | 1.5 | | | | | |
| 12 | | | 150 | 175 | 0.05 | 145 | 0.08 |
| | Exemplified compound No. 106 | 1.5 | | | | | |
| 13 | Exemplified compound No. 12 | 1.5 | 30 | 75 | 0.04 | — | — |
| 14 | Exemplified compound No. 113 | 1.5 | 60 | 45 | 0.04 | — | — |
| | Exemplified compound No. 12 | 1.5 | | | | | |
| 15 | | | 110 | 150 | 0.04 | 140 | 0.05 |
| | Exemplified compound No. 113 | 1.5 | | | | | |
| 16 | Exemplified compound No. 13 | 1.5 | 50 | 110 | 0.04 | — | — |
| 17 | Exemplified compound No. 116 | 1.5 | 80 | 40 | 0.05 | — | — |
| | Exemplified compound No. 13 | 1.5 | | | | | |
| 18 | | | 125 | 175 | 0.04 | 175 | 0.07 |
| | Exemplified compound No. 116 | 1.5 | | | | | |
| 19 | Exemplified compound No. 7 | 1.5 | 60 | 100 | 0.04 | — | — |
| 20 | Exemplified compound No. 111 | 1.5 | 90 | 40 | 0.04 | — | — |
| | Exemplified compound No. 7 | 1.5 | | | | | |
| 21 | | | 160 | 190 | 0.05 | 180 | 0.06 |
| | Exemplified compound No. 111 | 1.5 | | | | | |
| 22 | Exemplified compound No. 21 | 1.5 | 55 | 110 | 0.04 | — | — |
| 23 | Exemplified compound No. 119 | 1.5 | 75 | 30 | 0.04 | — | — |
| | Exemplified compound No. 21 | 1.5 | | | | | |
| 24 | | | 125 | 175 | 0.05 | 155 | 0.08 |
| | Exemplified compound No. 199 | 1.5 | | | | | |
| 25 | Exemplified compound No. 24 | 1.5 | 50 | 90 | 0.04 | — | — |
| 26 | Exemplified compound No. 121 | 1.5 | 80 | 30 | 0.05 | — | — |
| | Exemplified compound No. 24 | 1.5 | | | | | |
| 27 | | | 140 | 160 | 0.05 | 140 | 0.09 |
| | Exemplified compound No. 121 | 1.5 | | | | | |
| 28 | Exemplified compound No. 27 | 1.5 | 45 | 80 | 0.04 | — | — |
| 29 | Exemplified compound No. 122 | 1.5 | 60 | 30 | 0.04 | — | — |
| | Exemplified compound No. 27 | 1.5 | | | | | |
| 30 | | | 110 | 150 | 0.04 | 130 | 0.10 |
| | Exemplified compound No. 122 | 1.5 | | | | | |
| 31 | Exemplified compound No. 31 | 1.5 | 50 | 70 | 0.04 | — | — |
| 32 | Exemplified compound No. 125 | 1.5 | 75 | 25 | 0.05 | — | — |
| | Exemplified compound No. 31 | 1.5 | | | | | |
| 33 | | | 140 | 110 | 0.05 | 130 | 0.09 |
| | Exemplified compound No. 125 | 1.5 | | | | | |
| 34 | Exemplified compound No. 33 | 1.5 | 50 | 75 | 0.04 | — | — |
| 35 | Exemplified compound No. 126 | 1.5 | 70 | 40 | 0.04 | — | — |
| | Exemplified compound No. 33 | 1.5 | | | | | |
| 36 | | | 140 | 140 | 0.04 | 110 | 0.09 |
| | Exemplified compound No. 126 | 1.5 | | | | | |
| 37 | Exemplified compound No. 37 | 1.5 | 55 | 75 | 0.04 | — | — |
| 38 | Exemplified compound No. 128 | 1.5 | 60 | 30 | 0.04 | — | — |
| | Exemplified compound No. 37 | 1.5 | | | | | |
| 39 | | | 140 | 170 | 0.04 | 150 | 0.10 |
| | Exemplified compound No. 128 | 1.5 | | | | | |
| 40 | Exemplified compound No. 54 | 1.5 | 50 | 60 | 0.04 | — | — |
| 41 | Exemplified compound No. 111 | 1.5 | 80 | 40 | 0.05 | — | — |
| | Exemplified compound No. 54 | 1.5 | | | | | |
| 42 | | | 140 | 150 | 0.05 | 155 | 0.08 |
| | Exemplified compound No. 111 | 1.5 | | | | | |
| 43 | Exemplified compound No. 7 | 1.5 | 60 | 100 | 0.05 | — | — |
| 44 | Exemplified compound No. 101 | 1.5 | 80 | 40 | 0.05 | — | — |
| | Exemplified compound No. 7 | 1.5 | | | | | |
| 45 | | | 170 | 190 | 0.05 | 190 | 0.06 |
| | Exemplified compound No. 101 | 1.5 | | | | | |
| 46 | Exemplified compound No. 59 | 1.5 | 50 | 70 | 0.04 | — | — |
| 47 | Exemplified compound No. 116 | 1.5 | 75 | 25 | 0.04 | — | — |
| | Exemplified compound No. 59 | 1.5 | | | | | |
| 48 | | | 140 | 125 | 130 | 0.09 | |
| | | | | 0.04 | | | |
| | Exemplified compound No. 116 | 1.5 | | | | | |
| 49 | Exemplified compound No. 60 | 1.5 | 50 | 90 | 0.04 | — | — |
| 50 | Exemplified compound No. 121 | 1.5 | 75 | 45 | 0.04 | — | — |
| | Exemplified compound No. 60 | 1.5 | | | | | |
| 51 | | | 120 | 150 | 0.04 | 125 | 0.09 |
| | Exemplified compound No. 121 | 1.5 | | | | | |

*The comparative sensitizing dyes (A) and (B) represent the same compounds, respectively, as used in Example 1.

As is seen from Table 2, it is understood that when the present compounds of the general formulas [I] and [II] are used in combination, the light-sensitive silver halide photographic material markedly high in photographic speed can be obtained as compared with a photographic material obtained by using the present compound singly as well as with a photographic material obtained by using the combination of the comparative sensitizing dyes [A] and [B]. From the results obtained in the preservation test, it is understood that the light sensitive silver halide photographic materials obtained according to the present invention are found sufficiently satisfactory. Particularly, preferable results are obtained in the samples Nos. 6, 9, 12, 15, 18, 21, 42, 45 and 48.

Figure 2:
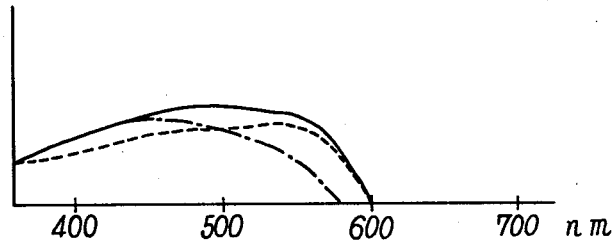

As can be seen from FIG. 2, the combination of the present compounds (the sample No. 21) produces optical supersensitization effect.

Similar optical supersensitization effect to that of the sample No. 21 was observed in the case of the sample No. 6, 9, 12, 15, 18, 24, 27, 30, 33, 36, 39, 42, 45, 48 as well as of No. 51.

Table 3

| Sample No.* | $S_B$ | $S_G$ | Fog |
|---|---|---|---|
| 1 | 45 | 100 | 0.04 |
| 2 | 65 | 35 | 0.04 |
| 3 | 65 | 95 | 0.04 |
| 19 | 45 | 75 | 0.04 |
| 20 | 65 | 30 | 0.05 |
| 21 | 120 | 140 | 0.05 |
| 37 | 50 | 65 | 0.04 |
| 38 | 45 | 30 | 0.04 |
| 39 | 120 | 140 | 0.04 |

*The sample numbers are the same as in Table 2.

As is seen from Table 3, it is understood from the results obtained in the test for high-illumination and short-time exposure that the samples Nos. 21 and 39 using the combination of the present compounds of the general formulas [I] and [II] give preferable results likewise similar to those as obtained in the case of irradiation commonly used (125 luces, 1 second) as compared with the case of the combination of the comparative sensitizing dyes [A] and [B].

EXAMPLE 3

After subjecting to chemical sensitization in the same manner as in Example 1, exactly the same emulsion as in Example 2 was divide into portions. To one of the thus divided portions was added, as stirring, a solution of a comparative sensitizing dye [C] ($1.5 \times 10^{-4}$ mole/1 kg emulsion) in a 1:1 solvent mixture of methanol and water then were added successively, while stirring, a solution of a comparative sensitizing dye [A] ($1.5 \times 10^{-4}$ mole/1 kg emulsion) in methanol, a 0.5% aqeuous solution of 4-hydroxy-6-methyl-1,3,3a,7-tetrazaindene (80 cc/1 kg emulsion), a 0.2% aqueous solution of a polyethylene glycol of an average molecular weight of 2000 (50 cc/1 kg emulsion), a 1% aqueous solution of monomethyloldimethyl hydantoin (200 cc/1 kg emulsion) and 1 liter of an aqueous solution of sodium dodecylbenzenesulfonate (200 cc/1 kg emulsion) to prepare a sample emulsion. Subsequently, this sample emulsion was coated on a subbed polyethylene terephthalate base and then dried to prepare a sample No. 1 (dry film thickness: 5μ).

Further, a sample No. 2 was prepared by using the comparative sensitizing dye [B] in place of the comparative sensitizing dye [A] and a sample No. 5 was prepared by using a combination of the sensitizing dyes [A] and [B] in place of the sensitizing dye [A], as shown in Table 4. Still further, using sensitizing dyes [D], [E], [F], [G], [H], [I] and [J], respectively, in place of the sensitizing dye [C], and using the exemplified compounds Nos. 7 and 111, respectively, in place of the comparative sensitizing dye [A], there were prepared samples Nos. 4–27 as shown in Table 4.

After cutting into a size suitable for measurement, the samples thus prepared were individually subjected to wedgewise exposure, development, stopping, fixing and water-washing to obtain strips having thereon a black-and-white image.

Exposure conditions: A light source having a color temperature of 5400° K. was used, a blue filter (Wratten No. 47B), green filter (Wratten No. 58B) and red filter (Wratten No. 25), each being a product of Eastman Kodak Co., were used in combination, the illumination employed was 125 luces for 1 second.

Development conditions: Same as in Example 2.

The strips having formed thereon a black-and-white image were individually measured in blue filter sensitivity ($S_B$), green filter sensitivity ($S_G$) and red filter sensitivity ($S_R$) and in fog by means of a K.D. Type densitometer manufactured by Konishiroku Photo Industry Co., Ltd.

The results obtained were as shown in Table 4, where the values of $S_B$, $S_G$ and $S_R$ of each sample were represented by relative values as measured by normalizing as 100 the value of $S_G$ of the sample No. 1.

Separately, three samples, i.e. the samples Nos. 13–15, were individually subjected to a diffraction grating spectral exposure apparatus using a light source having a color temperature adjusted to 5400° K. by means of a color temperature conversion filter to obtain spectrophotographs. The spectrophotographs thus obtained were individually developed under the same conditions as above and then measured in spectral sensitivity to obtain the results as shown in the accompanying FIG. 3.

Table 4

| Sample No. | Sensitizing dye | Amount added $\times 10^{-4}$ mole /1 kg emulsion | Dye | Amount added $\times 10^{-4}$ mole /1 kg emulsion | $S_B$ | $S_G$ | $S_R$ | Fog |
|---|---|---|---|---|---|---|---|---|
| 1 | Sensitizing dye (C)* | 1.5 | Comparative sensitizing dye (A)* | 1.5 | 60 | 100 | — | 0.04 |
| 2 | Sensitizing dye (C) | 1.5 | Comparative sensitizing dye (B)* | 1.5 | 50 | 80 | — | 0.04 |
| | | | Comparative sensitizing dye (A) | 1.5 | | | | |
| 3 | Sensitizing dye (C) | 1.5 | | | 70 | 110 | — | 0.04 |
| | | | Comparative sensitizing dye (B) | 1.5 | | | | |
| 4 | Sensitizing dye (C) | 1.5 | Exemplified compound No. 7 | 1.5 | 60 | 80 | — | 0.04 |
| 5 | Sensitizing dye (C) | 1.5 | Exemplified compound No. 111 | 1.5 | 85 | 80 | — | 0.04 |
| | | | Exemplified compound No. 7 | 1.5 | | | | |
| 6 | Sensitizing dye (C) | 1.5 | | | 150 | 200 | — | 0.04 |
| | | | Exemplified | 1.5 | | | | |

Table 4-continued

| Sample No. | Sensitizing dye | Amount added $\times 10^{-4}$ mole /1 kg emulsion | Dye | Amount added $\times 10^{-4}$ mole /1 kg emulsion | $S_B$ | $S_G$ | $S_R$ | Fog |
|---|---|---|---|---|---|---|---|---|
| | | | compound No. 111 | | | | | |
| 7 | Sensitizing dye (D)* | 1.5 | Exemplified compound No. 7 | 1.5 | 50 | 95 | — | 0.04 |
| 8 | Sensitizing dye (D) | 1.5 | Exemplified compound No. 111 | 1.5 | 70 | 100 | — | 0.04 |
| | | | Exemplified compound No. 7 | 1.5 | | | | |
| 9 | Sensitizing dye (D) | 1.5 | | | 160 | 210 | — | 0.05 |
| | | | Exemplified compound No. 111 | 1.5 | | | | |
| 10 | Sensitizing dye (E)* | 1.5 | Exemplified compound No. 7 | 1.5 | 50 | 85 | — | 0.04 |
| 11 | Sensitizing dye (E) | 1.5 | Exemplified compound No. 111 | 1.5 | 60 | 75 | — | 0.04 |
| | | | Exemplified compound No. 7 | 1.5 | | | | |
| 12 | Sensitizing dye (E) | 1.5 | | | 145 | 210 | — | 0.04 |
| | | | Exemplified compound No. 111 | 1.5 | | | | |
| 13 | Sensitizing dye (F)* | 1.5 | Exemplified compound No. 7 | 1.5 | 55 | 80 | 120 | 0.05 |
| 14 | Sensitizing dye (F) | 1.5 | Exemplified compound No. 111 | 1.5 | 80 | 70 | 120 | 0.05 |
| | | | Exemplified compound No. 7 | 1.5 | | | | |
| 15 | Sensitizing dye (F) | 1.5 | | | 150 | 190 | 120 | 0.05 |
| | | | Exemplified compound No. 111 | 1.5 | | | | |
| 16 | Sensitizing dye (G)* | 1.5 | Exemplified compound No. 7 | 1.5 | 60 | 180 | 30 | 0.04 |
| 17 | Sensitizing dye (G) | 1.5 | Exemplified compound No. 111 | 1.5 | 70 | 175 | 30 | 0.04 |
| | | | Exemplified compound No. 7 | 1.5 | | | | |
| 18 | Sensitizing dye (G) | 1.5 | | | 130 | 225 | 30 | 0.04 |
| | | | Exemplified compound No. 111 | 1.5 | | | | |
| 19 | Sensitizing dye (H)* | 1.5 | Exemplified compound No. 7 | 1.5 | 55 | 90 | 60 | 0.04 |
| 20 | Sensitizing dye (H) | 1.5 | Exemplified compound No. 111 | 1.5 | 60 | 45 | 60 | 0.04 |
| | | | Exemplified compound No. 7 | 1.5 | | | | |
| 21 | Sensitizing dye (H) | 1.5 | | | 125 | 140 | 60 | 0.04 |
| | | | Exemplfied compound No. 111 | 1.5 | | | | |
| 22 | Sensitizing dye (I)* | 1.5 | Exemplified compound No. 7 | 1.5 | 60 | 95 | 55 | 0.04 |
| 23 | Sensitizing dye (I) | 1.5 | Exemplified compound No. 111 | 1.5 | 70 | 85 | 50 | 0.04 |
| | | | Exemplified compound No. 7 | 1.5 | | | | |
| 24 | Sensitizing dye (I) | 1.5 | | | 130 | 160 | 50 | 0.04 |
| | | | Exemplified compound No. 111 | 1.5 | | | | |
| 25 | Sensitizing dye (J)* | 1.5 | Exemplified compound No. 7 | 1.5 | 55 | 100 | 80 | 0.04 |
| 26 | Sensitizing dye (J) | 1.5 | Exemplified compound No. 111 | 1.5 | 70 | 90 | 80 | 0.05 |
| | | | Exemplified compound No. 7 | 1.5 | | | | |
| 27 | Sensitizing dye (J) | 1.5 | | | 140 | 180 | 75 | 0.05 |
| | | | Exemplified | 1.5 | | | | |

Table 4-continued

| Sample No. | Sensitizing dye | Amount added $\times 10^{-4}$ mole /1 kg emulsion | Dye | Amount added $\times 10^{-4}$ mole /1 kg emulsion | $S_B$ | $S_G$ | $S_R$ | Fog |
|---|---|---|---|---|---|---|---|---|
| | | | compound No. 111 | | | | | |

*Comparative sensitizing dyes (A) and (B): Same as those used in Example 1.

*Sensitizing dye (C)

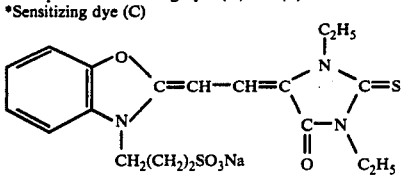

*Sensitizing dye (D)

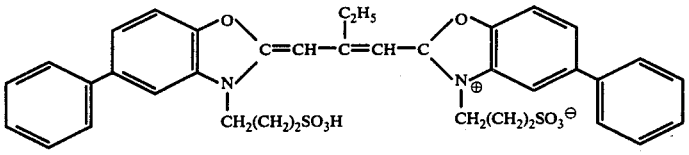

*Sensitizing dye (E)

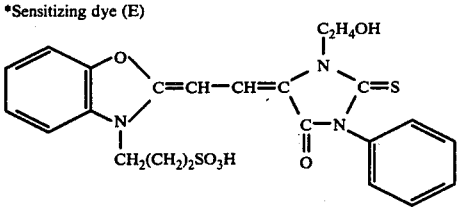

*Sensitizing dye (F)

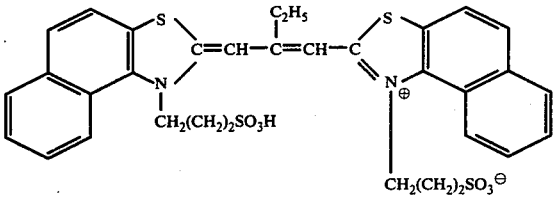

*Sensitizing dye (G)

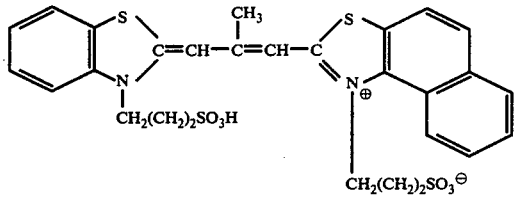

*Sensitizing dye (H)

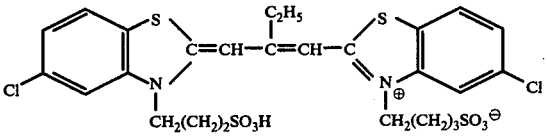

*Sensitizing dye (I)

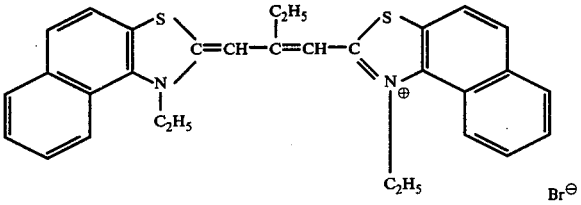

*Sensitizing dye (J)

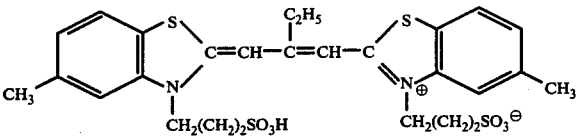

As is seen from Table 4, it is understood that even when the third sensitizing dyes, i.e. sensitizing dyes [C], [D], [E], [F], [G], [H], [I] and [J], were individually added to the combination of the present compounds of the general formulas [I] and [II] in a light-sensitive silver halide photographic material, no detrimental influence was exerted on the resulting light-sensitive silver halide photographic material of the present invention.

Figure 3:
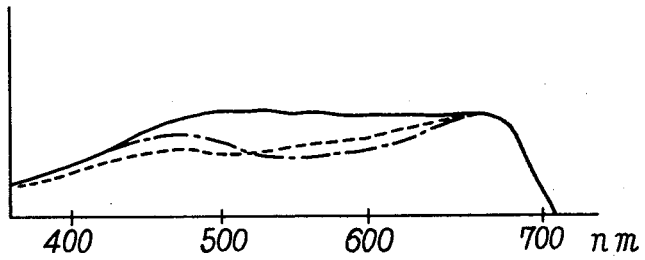

Further, viewed from FIG. 3 it is understood that optical supersensitization effect is observed in the combination of the present compounds (the sample No. 15) even when the sensitizing dye [F] is added thereto.

In the drawings simultaneously submitted herewith, FIG. 1 shows spectral sensitivity curves of the sample No. 10 (dot line), the sample No. 11 (chain line) and the sample No. 12 (solid line) used in Example 1, FIG. 2 shows spectral sensitivity curves of the sample 19 (dot line), the sample No. 20 (chain line) and the sample No. 21 (solid line) used in Example 2, and FIG. 3 shows spectral sensitivity curves of the sample No. 13 (dot line), the sample No. 14 (chain line) and the sample No. 15 (solid line) used in Example 3.

In each of FIGS. 1, 2 and 3, an ordinate represents a relative sensitivity and an abscissa represents a wavelength.

What is claimed is:

1. A light-sensitive silver halide photographic material comprising a support and thereon at least one silver halide emulsion layer containing silver halide, said silver halide emulsion layer containing at least one member selected from compounds represented by the following general formula [I] and at least one member selected from compounds represented by the following general formula [II]:

General formula [I]

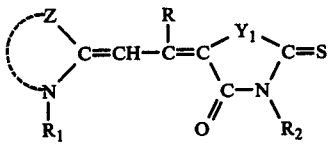

wherein Z represents a non-metal atomic group necessary for forming a pyrroline ring, $Y_1$ represents sulfur, R represents hydrogen or lower alkyl, and $R_1$ and $R_2$ individually represent an alkyl-, alkenyl- or aryl-group;

General formula [II]

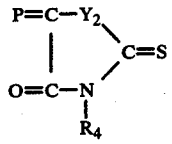

wherein P represents

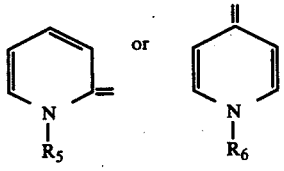

(in which $R_5$ and $R_6$ individually represent an alkyl-, alkenyl- or aryl-group), $Y_2$ represents oxygen, sulfur, selenium, or an $>N-R_7$ group (in which $R_7$ represents an alkyl-, alkenyl- or aryl-group), and $R_4$ represents an alkyl-, alkenyl- or aryl-group.

2. A light-sensitive silver halide photographic material according to claim 1 wherein $Y_2$ is sulfur.

3. A light-sensitive silver halide photographic material according to claim 2 wherein the silver halide has an average particle diameter of 0.1 to 0.6μ, and comprises more than 50 mol% of silver chloride and less than 5 mol% of silver iodide.

4. In a process for forming a black-and-white image in a light-sensitive silver halide photographic material comprising a support and thereon at least one silver halide emulsion layer containing silver halide, which process comprises: (a) imagewise exposing the light-sensitive photographic material to light, (b) developing said exposed light-sensitive photographic material with an infectious developer, the improvement which comprises said silver halide emulsion layer further containing at least one member selected from compounds represented by the following general formula [I] and at least one member selected from compounds represented by the following general formula [II]:

General formula [I]

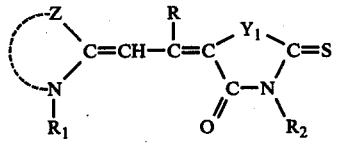

wherein Z represents a non-metal atomic group necessary for forming a pyrroline ring, $Y_1$ represents sulfur, R represents hydrogen or lower alkyl, and $R_1$ and $R_2$ individually represent an alkyl-, alkenyl- or aryl-group;

General formula [II]

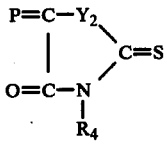

wherein P represents

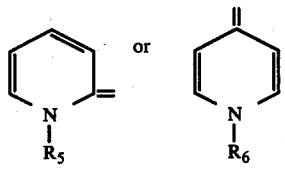

(in which $R_5$ and $R_6$ individually represent an alkyl-, alkenyl- or aryl-group), $Y_2$ represents oxygen, sulfur, selenium or an $>N-R_7$ group (in which $R_7$ represents an alkyl-, alkenyl- or aryl-group), and $R_4$ represents an alkyl-, alkenyl- or aryl-group.

5. A process according to claim 4 wherein $Y_2$ is sulfur.

6. A process according to claim 5 wherein the silver halide has an average particle diameter of 0.1 to 0.6μ and comprises more than 50 mol% of silver chloride and less than 5 mol% of silver iodide.

* * * * *